US007861359B1

(12) United States Patent
Ratzlaff

(10) Patent No.: US 7,861,359 B1
(45) Date of Patent: Jan. 4, 2011

(54) VEHICLE WINDOW WEATHER SEAL STRIP CLEANING TOOL

(76) Inventor: John Frederick Ratzlaff, 5550 Rowell Rd., Milton, FL (US) 32583

( * ) Notice: Subject to any disclaimer, the term of this patent is extended or adjusted under 35 U.S.C. 154(b) by 982 days.

(21) Appl. No.: 11/711,276

(22) Filed: Feb. 27, 2007

Related U.S. Application Data

(60) Provisional application No. 60/777,681, filed on Mar. 1, 2006.

(51) Int. Cl.
*A46B 5/00* (2006.01)
*A46B 9/00* (2006.01)

(52) U.S. Cl. ..... 15/160; 15/159.1

(58) Field of Classification Search ..... 15/143.1, 15/159.1, 160
See application file for complete search history.

(56) References Cited

U.S. PATENT DOCUMENTS 4,109,339 A * 8/1978 Dietrich ..... 15/167.1
5,070,570 A * 12/1991 Sabo ..... 15/160
5,740,586 A * 4/1998 Gomas ..... 16/436

* cited by examiner

*Primary Examiner*—Laura C Guidotti
(74) *Attorney, Agent, or Firm*—Peter Loffler

(57) ABSTRACT

A cleaning tool for cleaning the weather sealing strip at the windows of a vehicle has a flat elongate strip that has a brush end and a handle end joined by a medial section, the medial section being offset relative to the brush end by a first obtuse angle and being offset relative to the handle end by a second obtuse angle. The brush end as a twist offset relative to the handle end, the twist being right-handed for right-handed users. The brush end is tapered and has a rounded tip and has a brush material covering this end except at the rounded tip. A handle encompasses the handle end.

14 Claims, 4 Drawing Sheets

VEHICLE WINDOW WEATHER SEAL STRIP CLEANING TOOL

This application claims the benefit of provisional patent application No. 60/777,681 filed on Mar. 1, 2006, which provisional application is incorporated herein by reference.

BACKGROUND OF THE INVENTION

1. Field of the Invention

The present invention relates to a tool that cleans the weather window sealing strip or scraper which is located where a rollup window meets the outside top of a door of the vehicle.

2. Background of the Prior Art

Sand and dirt are common elements encountered during typical vehicle operation. Operating the vehicle at or near the beach, on a dirt road, or even on an Interstate highway during the non-rainy season, subjects the vehicle to sand and dirt, which elements accumulate on various locations about the vehicle. One such location where sand and grit tend to accumulate in sufficient amounts is on the rubberized weather sealing strip at the outside base of a rollup window whereat the window meets the door panel of the vehicle. Such accumulations can lead to problems for the vehicle owner.

When sufficient sand and grit accumulation on the weather sealing strip occurs, such debris acts on the pane of the window whenever the window is lowered and raised. The sand and other debris causes scratching of the glass of the window, which scratching, over time, leads to a highly unsightly and unclear pane. If the window has tint thereon, the tint, being much softer than the glass pane of the window, becomes scratched very easily so that the tint may need to be replaced in short order.

To combat this situation, many drivers wash their vehicles with regular frequency so that any sand or grit accumulation of the weather sealing strip can be washed away so as not to be a problem. However, sand and debris can accumulate quickly, oftentimes in just one trip to the beach for example, and vehicle owners may not have the time to wash the vehicle with the frequency needed to properly clean the sealing strip. Additionally, if a driver goes to the beach, where sand collects on the sealing strip, the driver cannot roll the window down until the driver arrives home and washes the vehicle, otherwise, window pane and tint scratching are a definite possibility.

Many drivers address this situation by carrying a cloth and using the cloth to wipe the surface of the weather sealing strip clean of sand and other debris. While the cloth removes some of the problem elements, much of the sand and dirt become lodged in the door cavity between the inner surface of the sealing strip and the window pane, where access to such dirt is difficult with an ordinary cloth. Accordingly, the cloth method of cleaning the weather sealing strip is of limited value.

What is needed is a device that can quickly and easily clean the weather sealing strip of a vehicle so as to remove accumulated sand and grit. Such a device must be able to access the inner facing surface of the sealing strip, in the crevices between the window and the door panel, areas that are not easily accessible by an ordinary cloth. Such a device must be of relatively simple design and construction so that it is relatively inexpensive to manufacture so as to be readily affordable to a large segment of the potential market for such products. The device must be relatively easy to use and maintain.

SUMMARY OF THE INVENTION

The vehicle window weather sealing strip cleaning tool of the present invention addresses the aforementioned needs in the art by providing a device that is able to quickly and easily clean the weather sealing strip of a vehicle in order to remove accumulated sand and grit. The vehicle window weather sealing strip cleaning tool is able to gain access into the crevices between the window and the door panel in order to be able to remove sand and grit on the inner facing surface of the sealing strip, an area that is not easily accessible by an ordinary cloth. The vehicle window weather sealing strip cleaning tool is of relatively simple design and construction so that the device is relatively inexpensive to manufacture, making the vehicle window weather sealing strip cleaning tool readily affordable to a large segment of the potential market for such products. The vehicle window weather sealing strip cleaning tool is relatively easy to use and maintain.

The vehicle window weather sealing strip cleaning tool of the present invention is comprised of a flat elongate strip member that has a first or brush end and a second or handle end joined by a medial section. The first end is offset from the medial section at a first obtuse angle while the second end is offset from the medial section at a second obtuse angle. The first section has an offset twist relative to the second end and the first end has a rounded tip. A brush material covers both sides of the first end with the exception of the rounded tip. The first end is tapered in proceeding from the medial section to the rounded tip. A handle encompasses the second end.

BRIEF DESCRIPTION OF THE DRAWINGS

Similar reference numerals refer to similar parts throughout the several views of the drawings.

DESCRIPTION OF THE PREFERRED EMBODIMENT

Figure 1:
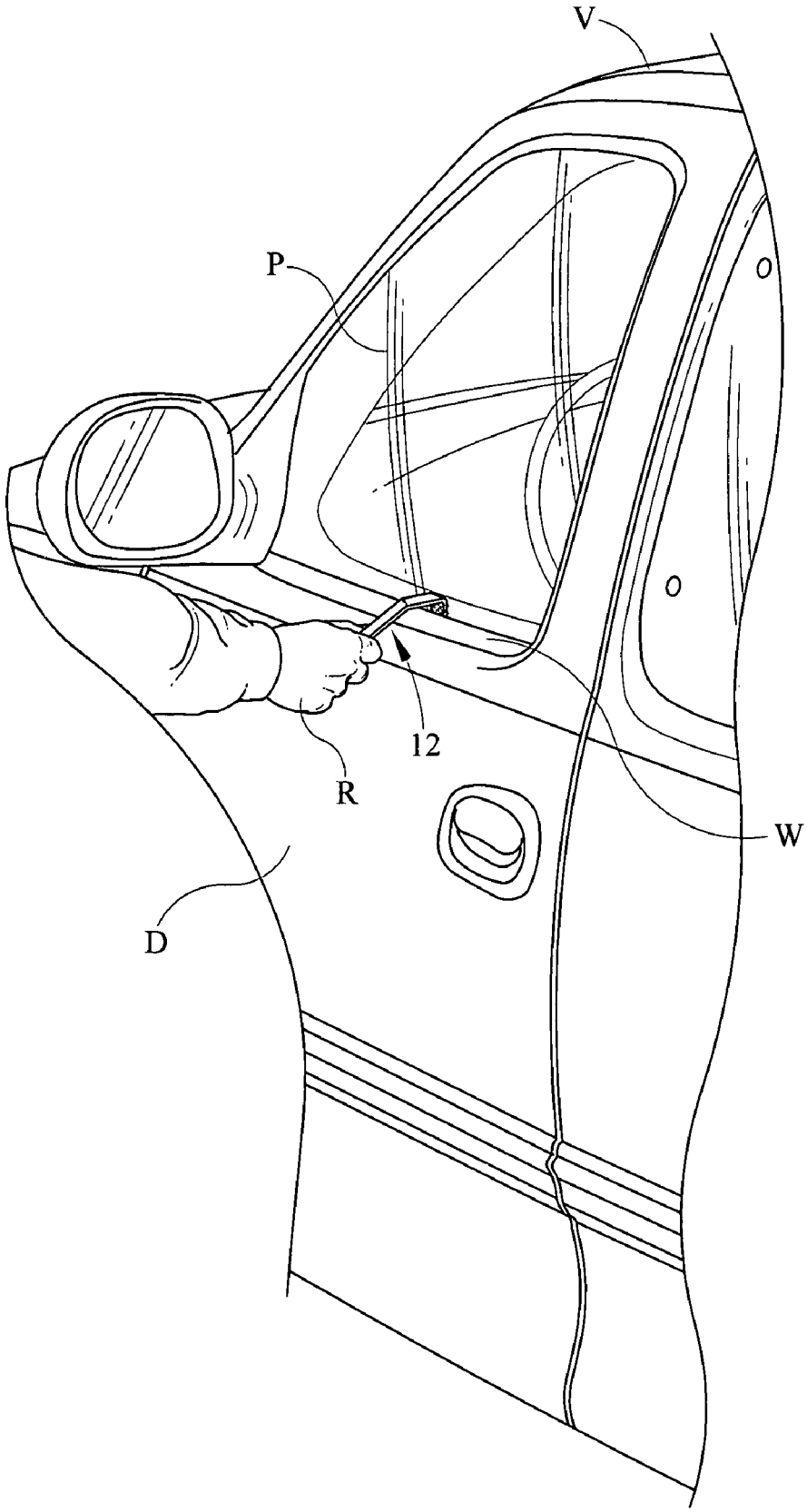
FIG. 1 is a perspective view of the vehicle window weather sealing strip cleaning tool of the present invention being used to clean the weather sealing strip of a vehicle.
Figure 2:
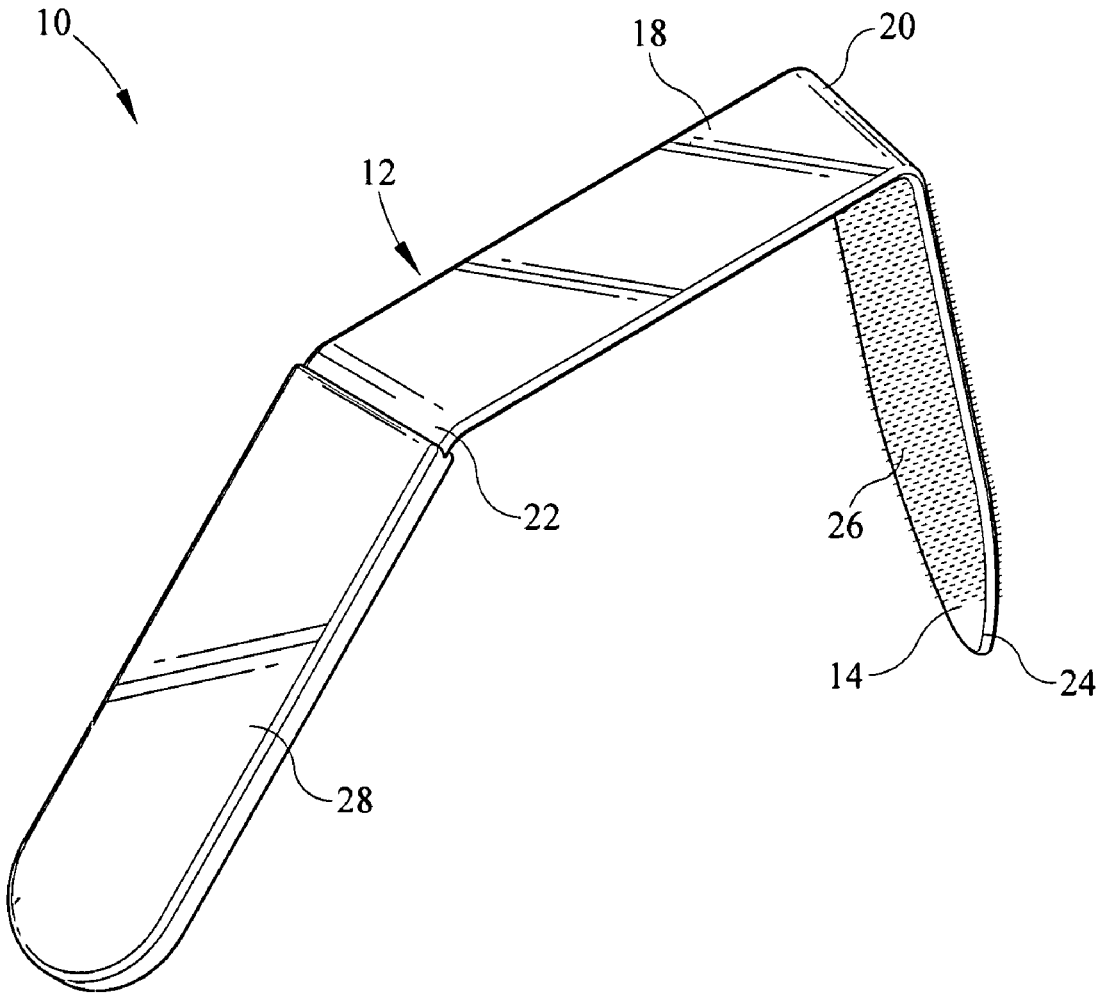
FIG. 2 is a perspective view of the vehicle window weather sealing strip cleaning tool.
Figure 3A:
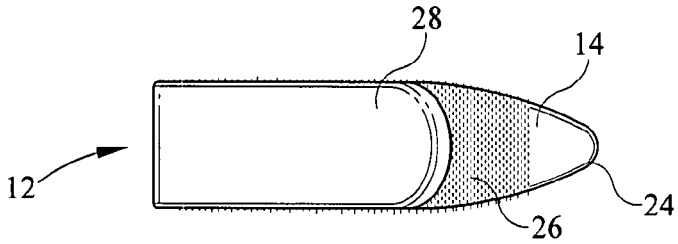
FIG. 3A is a front elevation view of the vehicle window weather sealing strip cleaning tool.
Figure 3B:
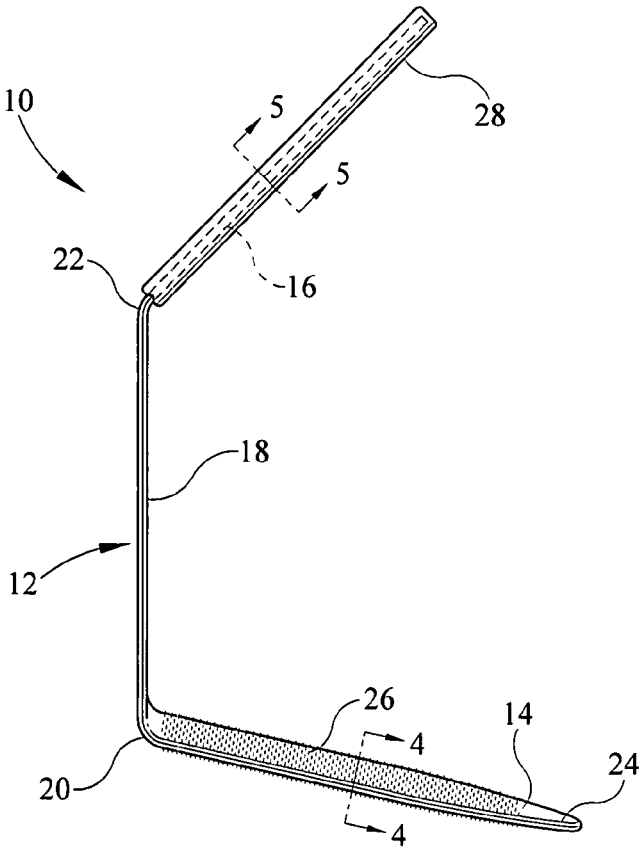
FIG. 3B is a side plan view of the vehicle window weather sealing strip cleaning tool.
Figure 3D:
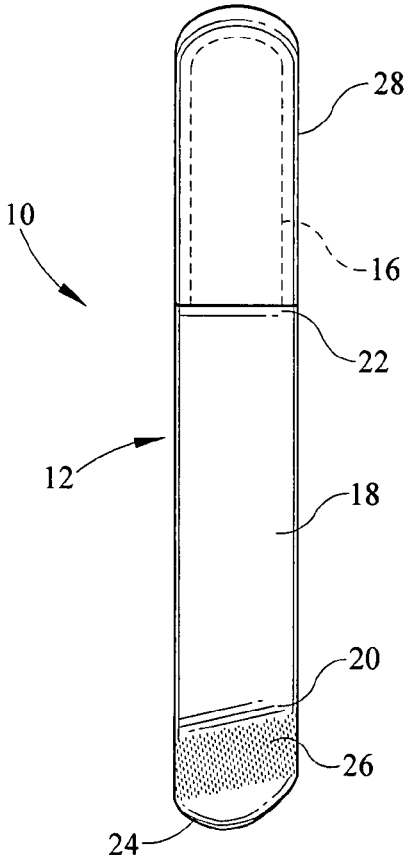
FIG. 3D is a bottom plan view of the vehicle window weather sealing strip cleaning tool.
Figure 3C:
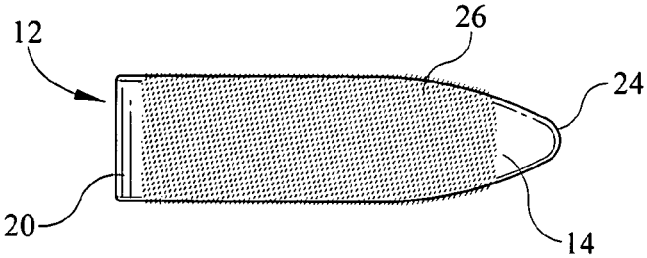
FIG. 3C is a rear elevation view of the vehicle window weather sealing strip cleaning tool.
Figure 4:
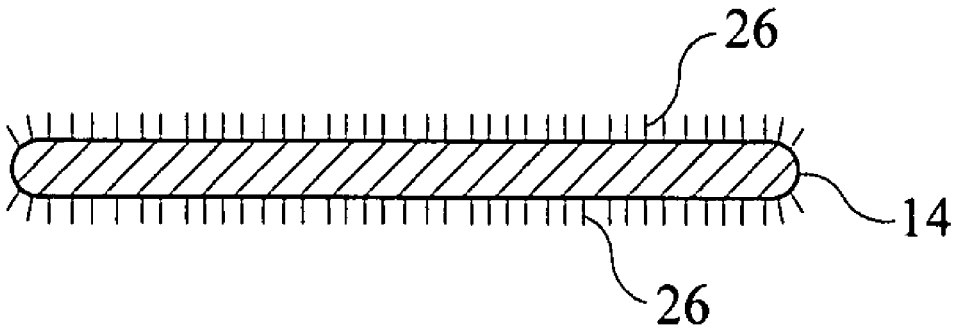
FIG. 4 is a sectioned view of the vehicle window weather sealing strip cleaning tool taken along line 4-4 in FIG. 3B.
Figure 5:
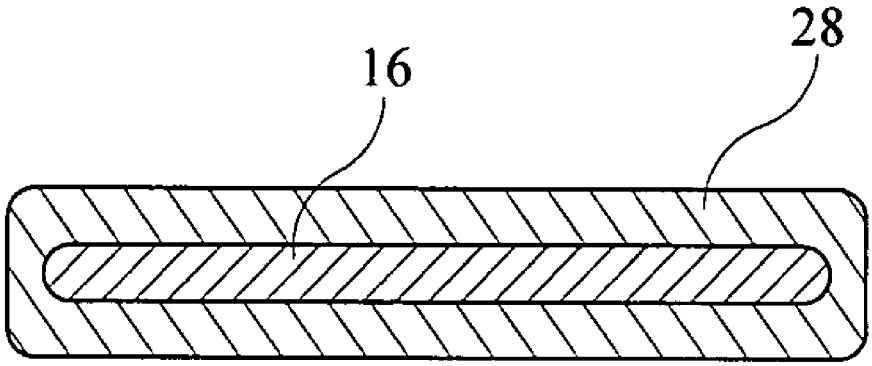
FIG. 5 is a sectioned view of the vehicle window weather sealing strip cleaning tool taken along line 5-5 in FIG. 3B.

Referring now to the drawings, it is seen that the vehicle window weather sealing strip cleaning tool of the present invention, generally denoted by reference numeral 10, is comprised of a flat elongate strip member 12, made from an appropriate resilient and hard material, such as a hard plastic or metal, wherein the strip member 12 has a first or brush end 14 and a second or handle end 16 joined by a medial section 18. As seen, the brush end 14 is joined to the medial section 18 by a first knuckle 20 and the brush end 14 is offset from the medial section 18 at an obtuse angle, the specific angle being in the neighborhood of about 100-110 degrees. Similarly, the handle end 16 is joined to the medial section 18 by a second knuckle 22 and the handle end 16 is also offset from the medial section 18 at an obtuse angle, the specific angle being in the neighborhood of about 130-140 degrees. As best seen in FIGS. 2, 3B and 3D, the handle end 16 has a right hand twist relative to the brush end 14, the twist occurring at either the first knuckle 20 or the second knuckle 22 and being in the neighborhood of about 10-20 degrees, optimally 15 degrees. The right hand twist is designed for a right-handed user of the device 10, the vehicle window weather sealing strip cleaning tool 10 can also be made for a left-handed user by implementing a left hand twist of the handle end 16 relative to the brush end 14. As seen, the brush end 14 may have a rounded tip 24 and may be tapered in proceeding from the first knuckle 20 to the rounded tip 24. The brush end 14, the medial section 18, the handle end 16, the first knuckle 20, and the second knuckle 22 may all comprise a single monolithic unit.

As seen, an appropriate brush material 26 covers the both the upper surface and the lower surface of the brush end 14 with the exception of the rounded tip 24.

As seen, an appropriate handle 28 encompasses the handle end 16 of the vehicle weather strip cleaning tool 10, the handle 28 being made from an appropriate easy grip material such as plastic, rubber, neoprene, etc.

In order to use the vehicle window weather sealing strip cleaning tool 10 of the present invention, the user grasps the handle end 16 of the device 10 with the right hand R in the case of a right-handed twist configuration, and uses the brush material 26 of the brush end 14 to clean sand and other debris from the weather sealing strip W of a vehicle V. The rounded tip 24 of the brush end 14, coupled with the tapering of this end 14, allows the device 10 to be slid down between the window pane P and the door panel D of the vehicle V in order to remove accumulated debris thereat, which debris is not easily accessible by the use of an ordinary cloth. The strip member 12 is sufficiently flexible and resilient so as to allow easy use of the device 10 within the crevices of the vehicle V. The twist of the handle end 16 relative to the brush end 14 allows a user to sweep the brush end 14 back and forth using wrist action coupled with appropriate arm movement in order to allow the device 10 to perform a thorough sweeping. Once all accumulated debris is cleared away, the device 10 is removed from the door panel D crevice, the brush material 26 cleaned as needed, and the device 10 stored until the next use.

While the invention has been particularly shown and described with reference to an embodiment thereof, it will be appreciated by those skilled in the art that various changes in form and detail may be made without departing from the spirit and scope of the invention.

I claim:

1. A brush comprising:

an elongate strip member having a top surface and an opposing bottom surface joined by a first side edge and an opposing second side edge such that the first side edge and the second side edge are relatively narrow with respect to the top surface and the bottom surface the strip member also having a first end that has a first upper surface and a first lower surface and a second end that has a second upper surface and a second lower surface joined by a medial section that has a third upper surface and a third lower surface such that the first upper surface, the third upper surface and the second upper surface form the top surface and the first lower surface, the third lower surface and the second lower surface form the bottom surface and such that the strip member has a first bend therein extending between the first side edge and the second side edge so that the first lower surface is angularly offset relative to the third lower surface and the strip member has a second bend therein extending between the first side edge and the second side edge so that the second lower surface is angularly offset relative to the third lower surface and such that the first lower surface faces toward the second lower surface, and the first section having an offset twist relative to the second end;

a brush material located on the first end.

2. The brush as in claim 1 wherein the first end has a rounded tip.

3. The brush as in claim 2 wherein the first end is tapered in proceeding from the medial section to the rounded tip.

4. The brush as in claim 1 further comprising a handle encompassing the second end.

5. The brush as in claim 1 wherein the thickness of the first end, between the first upper surface and the first lower surface is such so as to permit the first end to fit between an outer surface of a window on a vehicle door and an outer door panel of the door.

6. A brush comprising:

a flat elongate strip member having a top surface and an opposing bottom surface joined by a first side edge and an opposing second side edge such that the first side edge and the second side edge are relatively narrow with respect to the top surface and the bottom surface the strip member also having a first end that has a first upper surface and a first lower surface and a second end that has a second upper surface and a second lower surface joined by a medial section, that has a third upper surface and a third lower surface such that the first upper surface, the third upper surface and the second upper surface form the top surface and the first lower surface, the third lower surface and the second lower surface form the bottom surface and such that the strip member has a first bend therein extending between the first side edge and the second side edge so that the first lower surface is angularly offset relative to the third lower surface and the strip member has a second bend therein extending between the first side edge and the second side edge so that the second lower surface is angularly offset relative to the third lower surface and such that the first lower surface faces toward the second lower surface, and the first section having an offset twist relative to the second end;

a brush material located on the first end.

7. The brush as in claim 6 wherein the first end has a rounded tip.

8. The brush as in claim 7 wherein the first end is tapered in proceeding from the medial section to the rounded tip.

9. The brush as in claim 6 further comprising a handle encompassing the second end.

10. The brush as in claim 6 wherein the thickness of the first end, between the first upper surface and the first lower surface is such so as to permit the first end to fit between an outer surface of a window on a vehicle door and an outer door panel of the door.

11. A brush comprising:

a flat elongate strip member having a top surface and an opposing bottom surface joined by a first side edge and an opposing second side edge such that the first side edge and the second side edge are relatively narrow with respect to the top surface and the bottom surface the strip member also having a first end that has a first upper surface and a first lower surface and a second end that has a second upper surface and a second lower surface joined by a medial section, that has a third upper surface and a third lower surface such that the first upper surface, the third upper surface and the second upper surface form the top surface and the first lower surface, the third lower surface and the second lower surface form the bottom surface and such that the strip member has a first bend therein extending between the first side edge and the second side edge so that the first lower surface is angularly offset relative to the third lower surface and the strip member has a second bend therein extending between the first side edge and the second side edge so that the second lower surface is angularly offset relative to the third lower surface and such that the first lower surface faces toward the second lower surface, and the first section having an offset twist relative to the second end, the first end having a rounded tip;

a brush material covering the first end with the exception of the rounded tip.

12. The brush as in claim 11 wherein the first end is tapered in proceeding from the medial section to the rounded tip.

13. The brush as in claim 11 further comprising a handle encompassing the second end.

14. The brush as in claim 11 wherein the thickness of the first end, between the first upper surface and the first lower surface is such so as to permit the first end to fit between an outer surface of a window on a vehicle door and an outer door panel of the door.

* * * * *